US005761906A

United States Patent [19]

Norster

[11] Patent Number: 5,761,906

[45] Date of Patent: Jun. 9, 1998

[54] FUEL INJECTOR SWIRLER ARRANGEMENT HAVING A SHIELD MEANS FOR CREATING FUEL RICH POCKETS IN GAS-OR LIQUID-FUELLED TURBINE

[75] Inventor: Eric Roy Norster, Newark, United Kingdom

[73] Assignee: European Gas Turbines Limited, United Kingdom

[21] Appl. No.: 580,767

[22] Filed: Dec. 29, 1995

[30] Foreign Application Priority Data

Jan. 13, 1995 [GB] United Kingdom ..... 9500627

[51] Int. Cl.[6] ..... F02C 1/00

[52] U.S. Cl. ..... 60/737; 60/748; 60/742

[58] Field of Search ..... 60/737, 738, 732, 60/742, 748, 747, 749; 431/354

[56] References Cited

U.S. PATENT DOCUMENTS

| | | | |
|---|---|---|---|
| 2,834,405 | 5/1958 | Voorheis . | |
| 2,850,875 | 9/1958 | Gahwyler | 60/748 |
| 2,884,758 | 5/1959 | Oberle | 60/748 |
| 3,570,242 | 3/1971 | Leonardi et al. | 60/748 |
| 3,788,067 | 1/1974 | Carlisle et al. | 60/742 |
| 3,808,803 | 5/1974 | Salvi | 60/737 |
| 3,866,413 | 2/1975 | Sturgess | 60/742 |
| 4,343,147 | 8/1982 | Shekleton | 60/749 |
| 4,773,596 | 9/1988 | Wright et al. | 60/732 |
| 4,845,940 | 7/1989 | Beer | 60/732 |
| 4,898,001 | 2/1990 | Kuroda et al. . | |
| 5,127,221 | 7/1992 | Beebe . | |
| 5,163,287 | 11/1992 | Shekleton et al. . | |
| 5,323,614 | 6/1994 | Tsukahara et al. . | |
| 5,373,693 | 12/1994 | Zarzalis et al. | 60/748 |
| 5,450,724 | 9/1995 | Kesseli et al. . | |
| 5,513,982 | 5/1996 | Althaus et al. | 431/354 |

FOREIGN PATENT DOCUMENTS

| | | |
|---|---|---|
| 0 153 842 | 9/1985 | European Pat. Off. . |
| 0 583 300 A2 | 8/1993 | European Pat. Off. . |
| 660775 | 11/1951 | United Kingdom . |
| 1 271 332 | 4/1972 | United Kingdom . |
| 1 537 671 | 1/1979 | United Kingdom . |
| 2 035 540 | 6/1980 | United Kingdom . |
| 2 044 913 | 10/1980 | United Kingdom . |
| 1 601 558 | 10/1981 | United Kingdom . |
| 2 100 409 | 12/1982 | United Kingdom . |
| 2 215 028 | 9/1989 | United Kingdom . |
| 2 269 660 | 2/1994 | United Kingdom . |
| 2 270 974 | 3/1994 | United Kingdom . |
| 2 272 510 | 5/1994 | United Kingdom . |
| 2 280 022 | 1/1995 | United Kingdom . |
| 2 284 885 | 6/1995 | United Kingdom . |
| 2 287 312 | 9/1995 | United Kingdom . |

*Primary Examiner*—Timothy Thorpe
*Assistant Examiner*—Ted Kim
*Attorney, Agent, or Firm*—Kirschstein, et al.

[57] ABSTRACT

The arrangement comprises a swirler for producing at least one air stream for mixing with a supply of fuel but wherein the supply of fuel is initially injected into at least one zone adjacent a respective air stream but shielded (by 26) therefrom whereby fuel-rich pockets of fluid are formed in the zone(s). The pockets ensure flame stability at least at lower power settings. The zone is defined by a wall of the swirler. The fuel is injected through nozzles. Additional nozzles for supplementary supply of fuel may be provided in a block. A plate is arranged between the block and the swirler.

21 Claims, 2 Drawing Sheets

FUEL INJECTOR SWIRLER ARRANGEMENT HAVING A SHIELD MEANS FOR CREATING FUEL RICH POCKETS IN GAS-OR LIQUID-FUELLED TURBINE

BACKGROUND OF THE INVENTION

This invention relates to a fuel injector arrangement for use with a gas-or liquid-fuelled turbine.

The emission pollutant requirement for industrial combustion turbines are becoming ever more stringent. One of the main groups of pollutant hitherto produced by such engines are the nitrogen oxides (NOx). It is an object of the present invention to provide a fuel injector arrangement for a turbine which ensures low NOx emissions over a range of fuel supply pressures (i.e. power settings).

SUMMARY OF THE INVENTION

According to the invention there is provided a fuel injector arrangement for a turbine comprising means for producing at least one air stream for mixing with a supply of fuel and wherein fuel is injected into a zone adjacent said air stream from which the zone is at least partly shielded, whereby fuel-rich pockets of fluid are formed in the zone.

In another aspect the invention provides a method of operating a fuel injector arrangement of a turbine wherein at least one air stream is produced for mixing with a supply of fuel and wherein the fuel is injected into a zone adjacent said air stream from which the zone is at least partly shielded whereby fuel-rich pockets of fluid are formed in the zone.

The means for producing the air stream(s) preferably comprises a swirler means, which may be formed with a plurality of vanes, the swirler means being annular about the longitudinal axis of a combustor of the turbine and each vane acting to produce a said air stream. The vanes may be formed by the walls of slots in the body of the swirler means and the slots may be tangentially directed with respect to a prechamber region of the combustor.

Further injection means may be provided for injecting fuel directly into the prechamber.

The first mentioned injection means may comprise a plurality of first nozzles and the further injection means may comprise a plurality of second nozzles. The first and second nozzles may be formed in a block as a respective circular arrays about the longitudinal axis, with the first nozzles being radially outside the second nozzles.

The swirler means preferably has a wall acting as shield means to define the zone.

The swirler means may include a plurality of means to form respective streams of air which flow inwardly towards the prechamber from a region which surrounds the swirler. Each of said air stream forming means may be associated with a separate fuel injection nozzle, and may be provided with a barrier radially outside said nozzle to shield said zone. The barrier may constitute the end wall of the tangentially directed slots and the barrier's depth may be less than half the axial depth of said slots.

The swirler means may comprise an axial boss extending from the end wall, the end wall being of larger diameter than the boss.

BRIEF DESCRIPTION OF THE DRAWINGS

A fuel injector arrangement will now be described, by way of example, with reference to the accompanying drawings, in which.

DETAILED DESCRIPTION OF THE PREFERRED EMBODIMENTS

Figure 1:
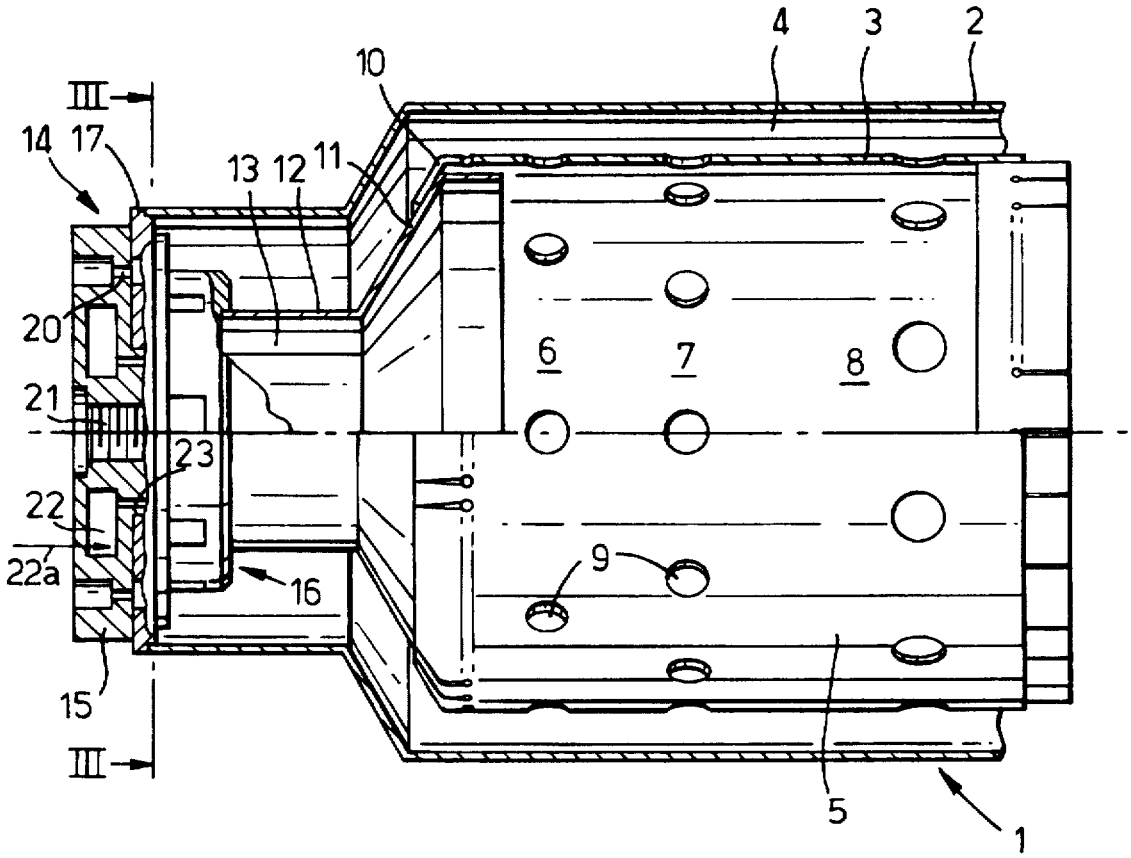
FIG. 1 shows an axial section of a combustion chamber with its associated fuel injector arrangement.

FIG. 1 shows a combustor 1 of a gas turbine engine. The combustor 1 comprises an outer cylindrical wall 2 and an inner cylindrical wall 3 (shown in external view in the lower half) defining therebetween an annular passage 4 for air which apart from providing oxygen for combustion also acts to cool the main combustion chamber 5 defined by the inner wall 3.

The main combustion chamber 5 itself comprises a primary combustion zone 6, an intermediate combustion zone 7 and a dilution zone 8. Holes 9 in the inner wall 3 allow air to enter the combustion chamber 5 from annular passageway 4. The cylindrical wall 3 of the combustor 1 has a tapered region 10 attached to a frusto-conical wall 11 leading into a cylindrical wall 12 of a further component and the walls 11, 12 define a pre-chamber 13 to the left of the main combustion chamber 5 as viewed in FIG. 1.

At the upstream end of the pre-chamber 13 i.e. to the left of FIG. 1 is provided a fuel injector assembly 14. This comprises a fuel injection block 15 and a swirler 16, there being an intermediate plate 17 arranged between the block 15 and the swirler 16 as shown in FIGS. 1, 2.

The swirler 16 acts to direct air radially inwardly in air streams indicated by arrows 18 in FIG. 2 and to mix the air with fuel injected by jets in the block 15 to an extent and in a manner described subsequently, dependent on the pressure of the fuel.

Figure 2:
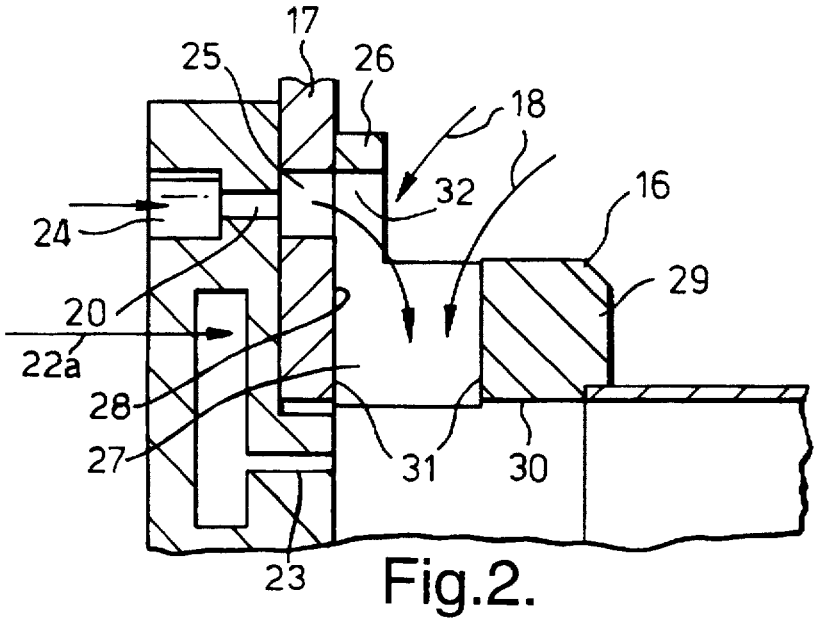
FIG. 2 shows part of FIG. 1 on an enlarged scale.

The swirler 16, shown in FIG. 2, comprises a boss 29 extending from a circular wall or rim 26 of larger diameter, an axial bore 30 extending through rim 26 and boss 29. Slots 31 tangential to bore 30 are milled into the face of the rim 26, the slots extending radially beyond the boss 29 which can be seen in FIG. 3 through the slots 31. The depth of the slots 31 is greater than the thickness of the plate 26 so exposing the outer ends of the slots to the air stream 18, as shown in Figure 2. Air entering the slots in this way from a region surrounding the swirler passes through to the bore 30 and enters the bore tangentially to produce a circular or swirling motion in the bore.

The block 15 comprises a radially outer array of injection nozzles 20, a central injector bore 21 and an intermediate annular fuel chamber 22 (fed by means 22*a* illustrated diagrammatically) itself provided with nozzles 23, each of which is positioned in the path of a swirler slot, so that each air stream is associated with a respective nozzle. The bore 21 may be utilized to house an igniter, or supply additional air, or an air fuel/mixture or an alternative fuel but since this is not critical to the invention it will be described no further.

The supply of fuel into the swirler 16 via nozzles 20 comprises the main fuel supply for the combustor 1, when operating in the low to upper power range.

Referring to FIG. 1 again, a direct fuel supply is provided by nozzles 23.

This direct fuel injection is useful in supplementing the air/fuel mixture to further improve flame stability at the lowest power settings and on engine starting. As power settings are increased the amount of direct fuel injection is proportionately reduced. In some configurations it may be possible to dispense with the direct fuel injection and rely entirely on the main fuel supply through nozzles 20.

Figure 3:
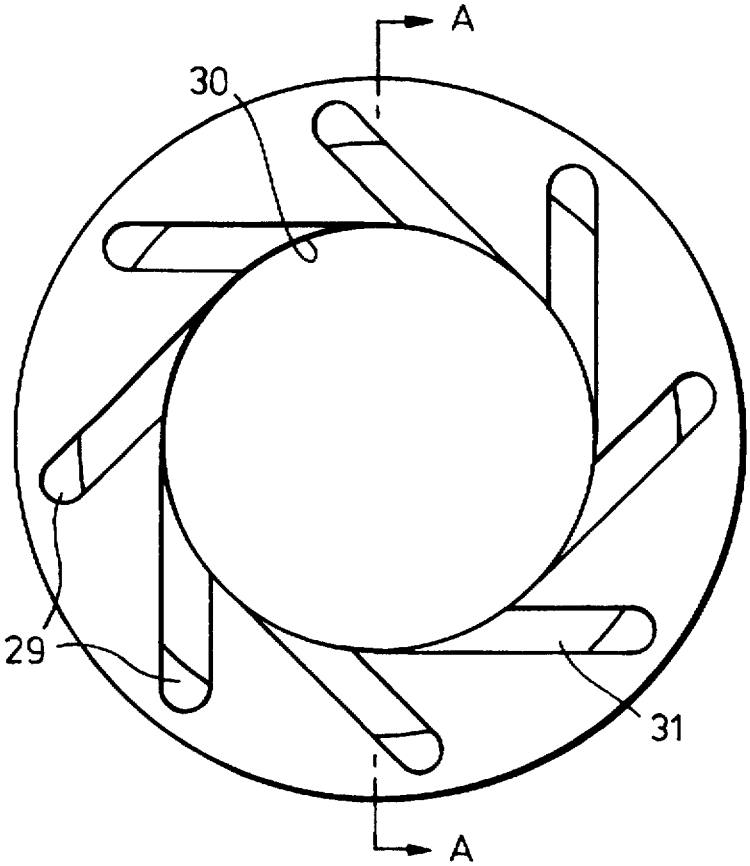
FIG. 3 shows an end view of the combustor of FIG. 1 on the line III—III.

At full power the fuel pressure is such as to inject fuel through an aperture 25 in the intermediate plate 17 and axially through a zone 32 in the end of the slot (also shown in FIG. 3). Beyond this zone 32 the jet of fuel is exposed to the radial/tangential streams of air 18 and is carried into the slot 31 providing a pre-mixed fuel/air supply. As the fuel pressure is reduced at low power however, the fuel jet enters the region 32, does not reach the main air stream 18 but is carried, relatively un-mixed, along the slot against the wall 28 of the plate 17 closing the slot and thence to the prechamber region. It may be seen that the outer wall 26 of the swirler 16 (i.e. the end wall of the slot radially outside nozzle 20) acts as a barrier to shield the fuel stream against the radial air stream which barrier is effective at least at low fuel pressures. Areas within the slot 31 adjacent plate 17 and indicated by numeral 27 act as further sheltered zones in which fuel rich pockets of gas are formed. It can be envisaged that under certain load conditions substantially neat fuel flows as a film radially inwardly along face 28 of plate 17. The aforesaid pockets of gas tend to survive as they are drawn into the prechamber 13 and thence into the main combustion chamber 5. While overall the fuel/air mixture may be lean in low power condition, these fuel rich pockets act to assist in the maintenance of flame stability at least at lower power settings.

As shown, the axial depth of wall 26 is less than half the axial depth of slots 31.

As fuel pressure increases i.e. at higher power settings the jets of fuel from nozzles 20 will project more and more into the main air stream in swirler 16 and this acts to give a uniform lean fuel mix to ensure low NOx formation.

It is envisaged that fuel supplies to bores 24 and to annular chamber 22 may be controlled independently or in common.

I claim:

1. A fuel injector arrangement for a turbine, said injector arrangement having a longitudinal axis and comprising: at least one swirler means having at least one air inlet means for entry of air into said at least one swirler means to provide the air for producing at least one air stream for mixing with a supply of fuel, said at least one air stream having a radial component of flow directed towards said longitudinal axis; injecting means for injecting said supply of fuel with a component of flow parallel to said longitudinal axis towards said at least one air stream and into said at least one swirler means for mixing of fuel and air; and shield means being provided adjacent said at least one air inlet means, said shield means at least partly shielding said supply of fuel from said at least one air stream in at least one region of said injector arrangement whereby, in said at least one region, fuel-rich pockets of fluid are formed.

2. The arrangement as claimed in claim 1, wherein the shield means is constituted by a wall provided in said at least one swirler means.

3. The arrangement as claimed in claim 2, wherein said at least one swirler means is formed with a plurality of vanes, said swirler means being annular about the longitudinal axis of the injector arrangement, and each vane acting to produce a said air stream.

4. The arrangement as claimed in claim 3, wherein said at least one swirler means has a body having walls bounding slots, and wherein the vanes are formed by the walls of the slots.

5. The arrangement as claimed in claim 4, wherein the slots are tangentially directed with respect to a prechamber region of a combustor of the turbine.

6. The arrangement as claimed in claim 5, also comprising further injection means for injecting fuel directly into the prechamber region.

7. The arrangement as claimed in claim 6, wherein the injecting means comprises a plurality of first nozzles.

8. The arrangement as claimed in claim 7, wherein the first nozzles are formed in a block as a circular array about said longitudinal axis.

9. The arrangement as claimed in claim 6, wherein the further injection means comprises a plurality of second nozzles.

10. The arrangement as claimed in claim 9, wherein the second nozzles are formed in a block as a circular array a bout said longitudinal axis.

11. The arrangement as claimed in claim 10, wherein the first nozzles are formed radially outside the second nozzles.

12. The arrangement as claimed in claim 1, wherein said at least one swirler means has a wall which constitutes the shield means.

13. The arrangement as claimed in claim 1, wherein said at least one swirler means includes a plurality of means for forming respective streams of air which flow towards a prechamber from a region which surrounds the swirler means.

14. The arrangement as claimed in claim 13, wherein each of said air stream forming, means is associated with a separate fuel injection nozzle.

15. The arrangement as claimed in claim 14, wherein each of said air stream forming means is provided with a wall forming a barrier positioned radially outside of said associated nozzle to constitute said shield means.

16. The arrangement as claimed in claim 15, wherein said at least one swirler means has a body formed with tangentially directed slots, and wherein said barrier wall is constituted by an end wall of the tangentially directed slots formed in the body of the swirler means.

17. The arrangement as claimed in claim 16, wherein the slots have a predetermined depth, and wherein said barrier has a depth which is less than half the predetermined depth of said slots.

18. The arrangement as claimed in claim 1, wherein said at least one swirler means comprises an axial boss having a predetermined diameter and extending from an end wall, said end wall being of larger diameter than the predetermined diameter of said boss.

19. A fuel injector arrangement for a turbine, said injector arrangement having a longitudinal axis and comprising: at least one swirler means having at least one air inlet means for entry of air into said at least one swirler means to provide the air for producing at least one air stream for mixing with a supply of fuel said air stream having a radial component of flow directed towards said longitudinal axis; means for injecting said fuel with a component of flow parallel to said longitudinal axis towards said airstream and into said at least one swirler means for mixing of fuel and air; and shield means being provided adjacent said at least one air inlet means, said shield means at least partly shielding said supply of fuel injecting means from said at least one air stream in at least one region of said injector arrangement, at least when the supply of fuel is at low pressure, whereby, in said at least one region, fuel-rich pockets of fluid are formed.

20. A method of operating a fuel injector arrangement of a turbine, said arrangement having a longitudinal axis and including a swirler means having an air inlet means for entry of air, the method comprising the steps of: utilizing said swirler means for entry of the air therein to provide the air to produce at least one air stream having a radial component of flow directed towards said longitudinal axis; injecting fuel with a component of fuel flow parallel to said longitudinal axis towards said air stream and into said swirler means for mixing of fuel and air; and at least partly shielding said injected fuel from said air stream in at least one region of said injector arrangement by providing a shield means adjacent the air inlet means so as to give rise to fuel-rich pockets of fluid in said at least one region.

21. A method of operating a fuel injector arrangement of a turbine, said arrangement having a longitudinal axis and including a swirler means having an air inlet means for entry of air, the method comprising the steps of: utilizing said swirler means for entry of the air therein to provide the air to produce at least one air stream having a radial component of flow directed towards said longitudinal axis; injecting fuel with a component of fuel flow parallel to said longitudinal axis towards said air stream and into said swirler means for mixing of fuel and air; and at least partly shielding said injected fuel from said air stream in at least one region of said injector arrangement by providing a shield means adjacent the air inlet means, at least when the injected fuel is at low pressure so as to give rise to fuel-rich pockets of fluid in said at least one region.

* * * * *